US006405796B1

(12) United States Patent
Meyer et al.

(10) Patent No.: US 6,405,796 B1
(45) Date of Patent: Jun. 18, 2002

(54) METHOD FOR IMPROVING OIL RECOVERY USING AN ULTRASOUND TECHNIQUE

(75) Inventors: Robert J. Meyer, Penfield; Christine J. Tarnawskyj, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/699,862

(22) Filed: Oct. 30, 2000

(51) Int. Cl.[7] ..... E21B 28/00; E21B 43/25
(52) U.S. Cl. ..... 166/249; 166/268
(58) Field of Search ..... 166/249, 268, 166/177.1, 177.2, 177.6

(56) References Cited

U.S. PATENT DOCUMENTS

| | | | | | |
|---|---|---|---|---|---|
| 3,754,598 | A | * | 8/1973 | Holloway, Jr. | 166/249 |
| 4,679,627 | A | * | 7/1987 | Harrison | 166/249 |
| 5,660,231 | A | * | 8/1997 | Belonenko | 166/249 |
| 6,186,228 | B1 | * | 2/2001 | Wegener et al. | 166/249 |
| 6,241,019 | B1 | * | 6/2001 | Davidson et al. | 166/249 |

OTHER PUBLICATIONS

M.A. Biot, *Theory of Propagation of Elastic Waves in a Fluid–Saturated Porous Solid*, Mar. 1956, 168.

M.A. Biot, *Theory of Propagation of Elastic Waves in a Fluid–Saturated Porous Solid*, Mar. 1956, 179.

M.A. Biot, *Mechanics of Deformation and Acoustic Propagation in Porous Media*, Apr. 1962, 1482.

D.L. Johnson, T.J. Plona and H. Kojima, *Probing Porous Media with First and Second Sound. II. Acoustic Properties of Water–Saturated Porous Media*, Mar. 1994, 115.

T.J. Plona, R. D'Angelo and D.L. Johnson, *Velocity and Attenuation of Fast, Shear and Slow Waves in Porous Media*, 1991, 1233–1239.

J.E. White, *Seismic Waves: Radiation, Transmission and Attenuation*, 1965, 70.

W.A. Gray, *The Packing of Solid Particles*, 1968, 34.

* cited by examiner

*Primary Examiner*—William Neuder
(74) *Attorney, Agent, or Firm*—Lloyd E. Bean, II

(57) ABSTRACT

A method and apparatus for and aggregates in a fluid medium. The present invention employs an ultrasonic device to efficiently breakup particle agglomerates by driving the ultrasonic signal over a small range of frequencies around the acoustic slow wave frequency of the saturated agglomerate. At this frequency, the fluid vibrates out of phase with the solid and is forced out through the pore structure in the agglomerate. This relative fluid motion to exert high viscous stresses at the particle-particle contact points which leads to fracture of the agglomerate and the redispersion of the individual particles. The apparatus includes a dispersing vessel containing aggregates of particles in a fluid, a sonic member for applying an ultrasonic signal in said dispersing vessel for separating the aggregates to form dispersed particles.

3 Claims, 7 Drawing Sheets

METHOD FOR IMPROVING OIL RECOVERY USING AN ULTRASOUND TECHNIQUE

This invention relates to the recovery of oil from subterranean oil reservoirs and, more particularly, to an improved waterflooding operations involving the use of ultrasound technique to improve oil recovery.

BACKGROUND OF THE INVENTION

Cross reference is made to the following applications filed concurrently herewith: Attorney Docket Number D/A0026 entitled "Process lo And Apparatus For Obtaining Ink Dispersions By Subjecting The Liquid Inks To An Ultrasonic or Sonic Signal", Attorney Docket Number D/A0026Q1 entitled "A Method For Removing Trapped Impurity Aggregates From A Filter", Attorney Docket Number D/A0026Q2 entitled "Method For Dispersing Red And White Blood Cells", Attorney Docket Number D/A0871 entitled "An Ultrasonic Method For Improving Cleaning And Redispersal Of Saturated Particle Aggregates In Processes Using Liquid Inks", Attorney Docket Number, Attorney Docket Number D/A0870 entitled "An Ultrasonic Method For Speeding The Drying Of Fluid Saturated Images In Processes Using Liquid Inks", and Attorney Docket Number D/A0998 entitled "Method For Manufacturing Process".

References

M. A. Biot, J. Acoust. Soc. Am. 28,168 (1956).
M. A. Biot, J. Acoust. Soc. Am. 28 179 (1956).
M. A. Biot, J. Appl. Phys. 33, 1482 (1962).
D. L. Johnson, T. J. Plona, and H. Kojima, J. Appl. Phys. 76(1), 115 (1994).
T. J. Plona, R. D'Angelo, and D. L. Johnson, "Velocity and attenuation of fast, shear, and slow waves in porous media", in *IEEE* 1990 *Ultrasonics symposium Proceedings*, Vol 3, B. R. McAvoy editor. IEEE, N.Y. (1991), 1233–1239.
J. E. White, *Seimic waves: radiation, transmission, and attenuation*, McGraw-Hill book Company, New York, N.Y., 1965, pg. 70.
J. C. Williams, *The packing of solid Particles*, Chapman and Hall, Ltd. London, England, 1968, pg 34.

In the recovery of oil from oil-bearing reservoirs, it is usually possible to recover only minor portions of the original oil in place by the so-called primary recovery methods which utilize only the natural forces present in the reservoir. A variety of supplemental recovery techniques have been employed in order to increase the recovery of oil from subterranean reservoirs. The most widely used supplemental recovery technique is waterflooding which involves the injection of water into the reservoir. As the water moves through the reservoir, it acts to displace oil therein to a production system composed of one or more wells through which the oil is recovered.

It has long been recognized that factors such as the interfacial tension between the injected water and the reservoir oil, the relative mobilities of the reservoir oil and injected-water, and the wettability characteristics of the rock surfaces within the reservoir are factors which influence the amount of oil recovered by waterflooding. It has been proposed to add surfactants to the floodwater in order to lower the oil/water interfacial tension and/or alter the wettability characteristics of the reservoir rock. Processes which involve the injection of aqueous surfactant solutions are commonly referred to as surfactant waterflooding or as low-tension waterflooding, the latter term having reference to the mechanism involving the reduction of the oil-water interfacial tension. Also, it has been proposed to add viscosifiers such as polymeric thickening agents to all or part of the injected water in order to increase the viscosity thereof, thus decreasing the mobility ratio between the injected water and oil and improving the sweep efficiency of the waterflood.

SUMMARY OF THE INVENTION

An object of the present invention is to improve waterflooding operations involving the use of ultrasound technique to improve oil recovery. There is provided a method for recovering oil from a subterranean formation including injecting an aqueous composition into said formation and displacing said oil toward one or more production wells; subjecting the aqueous composition to an ultrasonic signal to release oil from the formation; and removing the aqueous composition containing oil from said one or more production wells.

BRIEF DESCRIPTION OF THE DRAWINGS

Other features and advantages of the present invention will become apparent as the following description proceeds and upon reference to the drawings, in which.

DETAILED DESCRIPTION OF THE INVENTION

Figure 1:
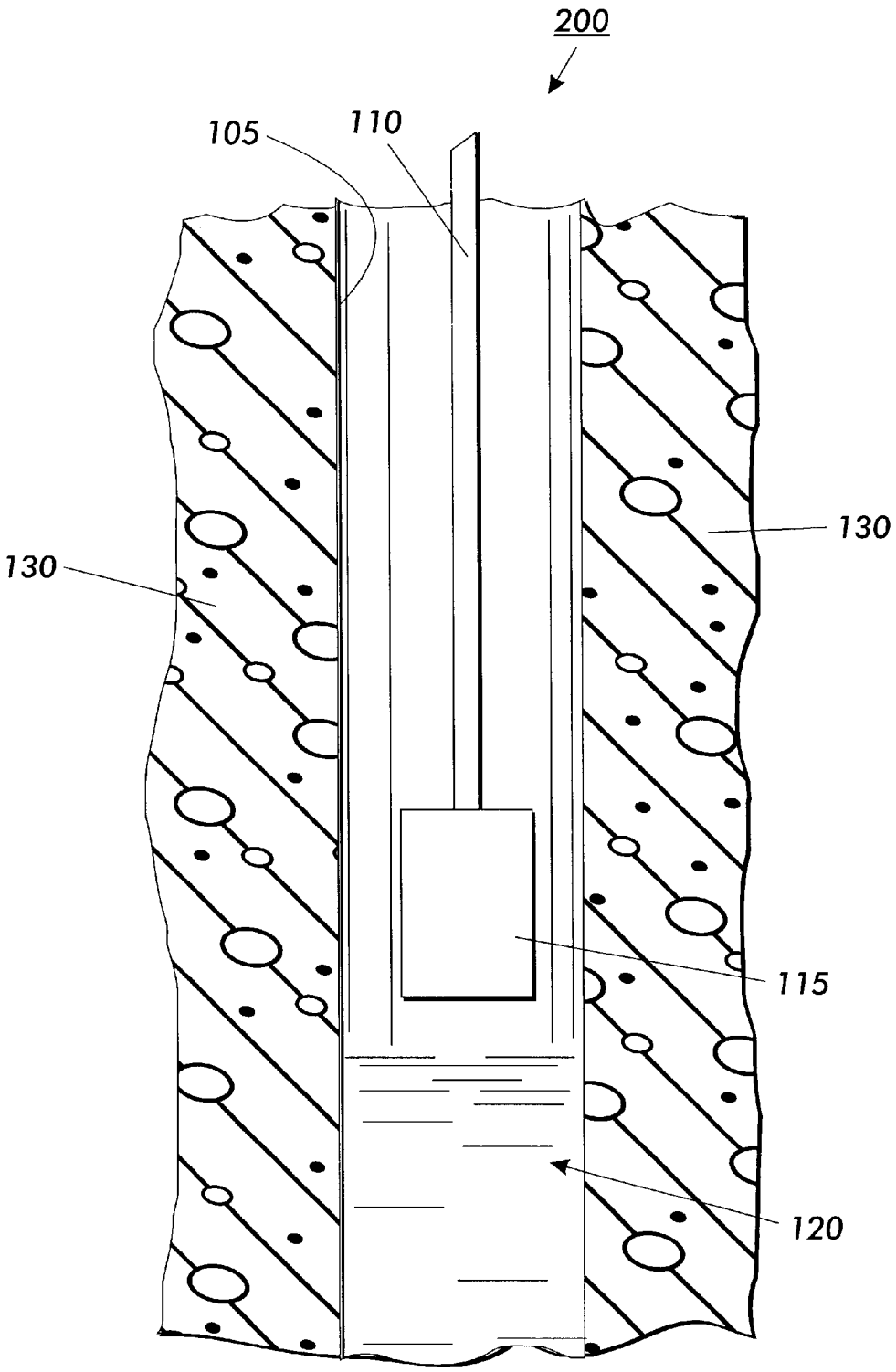
FIG. 1 is a schematic of an apparatus used in oil recovery method of the present invention.

As shown in FIG. 1, an ultrasonic source 115 is suspended by cable 110 within the borehole 105 of the waterflood injection well 200 to release oil porous rock layers 130. The areas of the oil reservoir through which injected water or other injected fluids flow is referred to as being on the percolation path for fluid transport. Adjacent areas are referred to as being off the percolation path. Ultrasonic source 115 employs an acoustic slow wave technique is to obtain motion of fluids not on the percolation path of motion achieved via static or quasi-static fluid pressure gradients. Enhanced oil recovery by forcing heated water or steam through the rocks is secondary recovery. The fluid flooding by heated water or steam opens percolation flow through the porous rocks along a limited number of paths. Use of ultrasound techniques with frequencies tailored to oil densities and viscosities and rock pore sizes or particle sizes can excite acoustic slow waves in the trapped oil. These slow wave excitations will induce an oscillatory motion in the pore fluids; both in situ water, oil, and injected fluids. These oscillatory motions move these fluids, including oil, from one pore to adjacent pores. If there is no percolation flow in the neighborhood, the oscillatory motions cancel on alternate ultrasonic wave half cycles and no net oil motion results. If, however, there is neighboring percolation flow then it acts to break the back and forth oil motion symmetry by removing oil on the ultrasound cycles that push oil onto the percolation flow path. Thus the ultrasound induces continual oil migration to percolation paths, where it can be recovered by the fluid flow along these percolation paths. This constitutes a method of tertiary recovery not currently utilized. This would be accomplished by superposing the acoustic slow wave frequency ultrasonic oscillation on the pressure pulse of the water or steam forced into the rocks. The issues discussed below for feedback techniques for controlling the oscillation frequency also apply here.

Ultrasound frequencies could be superposed on the fluid flows used in tertiary oil recovery in several ways. One approach is to add an ultrasonic transducer either within the water pump output pipe, or surrounding the water pump output pipe. Another approach is to suspend an ultrasonic probe within the pipe at the appropriate depth level where oil is to be recovered in the ground.

Figure 2:
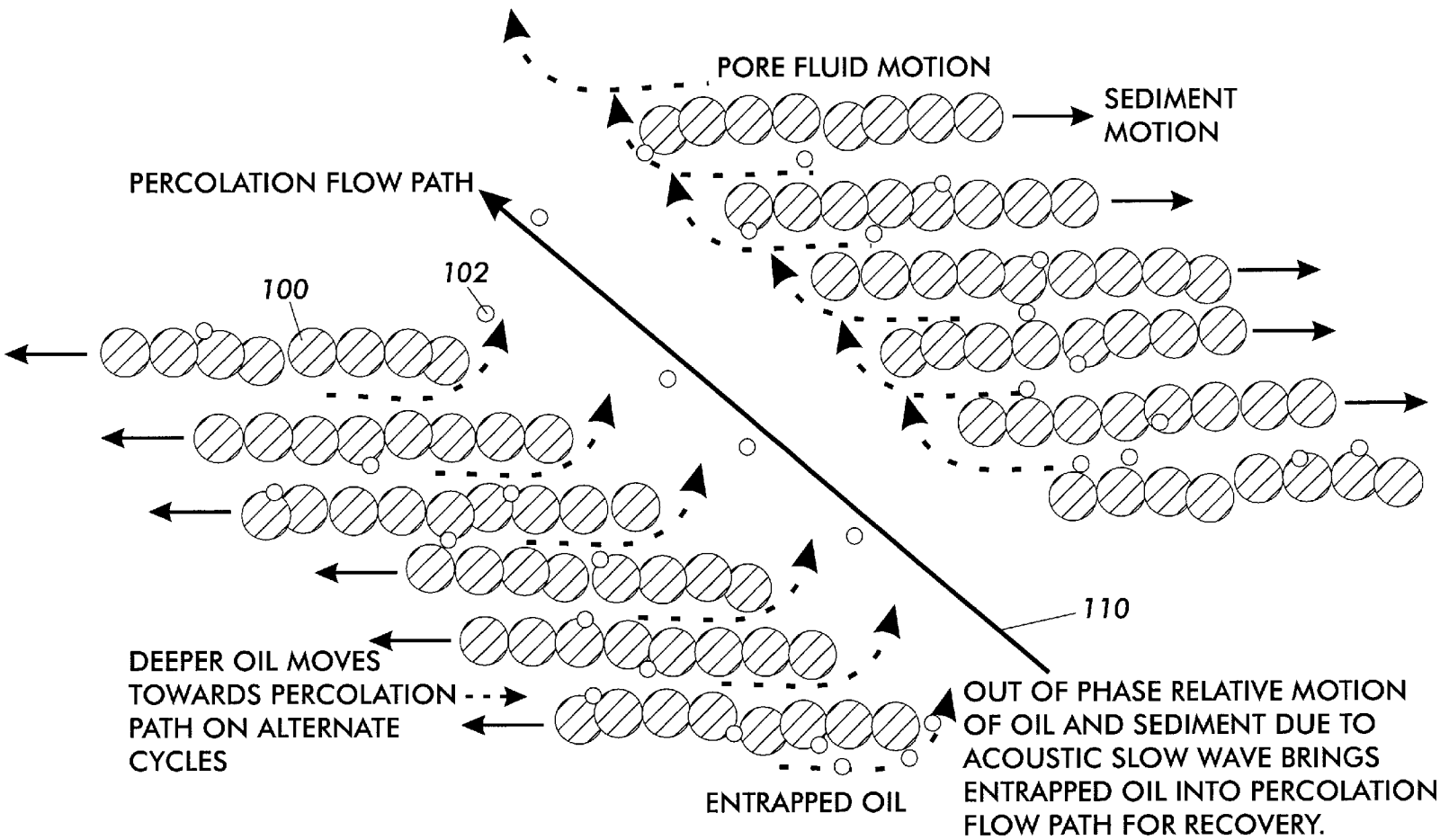
FIG. 2 illustrates the motion of oil or other pore fluid under the influence of an acoustic slow wave near a waterflood percolation flow path.

Having in mind the main elements of the present invention, and not wanting to be limited to theory, the present invention is believed to operate as follows: when a rock containing a pore fluid, be it in situ water, oil, or injected fluid, is subject to a sound wave, the fluid and the rock will oscillate in the direction of propagation of the sound wave. In general, the fluid and the porous rock respond at slightly different rates. In the limit of very low frequency the porous rock and the pore fluid will respond completely in phase, resulting in no net motion of the pore fluid with respect to the surrounding rock. As the frequency of the driving sound wave increases, the viscous fluid motion lags slightly behind that of the approximately rigid solid. This results in fluid motion through pores in the rock. As the frequency increases, the phase lag in relative motion between the rock and liquid also increases, at least up to a point. At a point called the acoustic slow wave point the motion of the solid and liquid will be 180 degrees out of phase. At this point we have the maximum amount of motion of the pore fluid with respect to the porous rock. See FIG. 2 for an illustration of the oil motion near a waterflood percolation flow path under the influence of an acoustic slow wave. Thus, when excited at the slow wave frequency, on alternate sound wave half cycles the maximum amount possible of pore fluid is moved from previously inaccessible pores adjacent to the percolation flow path into the flow path, where in can be carried away. On intervening sound wave half cycles fluid containing surfactants from the percolation flow path is injected into surrounding pores in the rock, thus increasing the size of the percolation flow domain. Thus, both ultrasound half cycles perform useful functions for secondary oil recovery: removing previously inaccessible oil from rock surrounding the percolation flow path, and enlarging the area of the oil reservoir accessible to surfactants and percolation flow.

The first analysis of these different modes of fluid motion was carried out by Biot (1956a,b; 1962), and has been a topic of continuing research [see Johnson, Plona, and Kojima (1994) and references cited therein]. The acoustic slow wave mode is also sometimes called the "compressional slow wave" or just the "slow wave". These waves have been observed experimentally in a variety of porous solids, and are well verified (Johnson, et. al., 1994).

The frequency of the acoustic slow wave mode, $f_c$, in an infinite porous solid is given by (White, 1965):

$$f_c=\eta\phi/(2\pi k\rho_f) \tag{1}$$

where $\eta$ is the fluid viscosity, $\phi$ is the aggregate porosity, k is the reservoir permeability, and pa is the fluid density. The rock porosity $\phi$ depends on the volume fraction of solids in the reservoir via:

$$\phi=1-(\%\ S/100) \tag{2}$$

where %S is the percent of solids in the rock, by volume, $\eta$ is the fluid viscosity, $\phi$ is the aggregate porosity, k is the reservoir permeability, and $\rho_f$ is the fluid density.

The rock porosity, $\phi$, can be estimated from sonic logs using the Wyllie relationship, from density logs, from neutron logs, or from resistivity logs via Archie's formula. In addition, porosity can be obtained directly from rock core samples removed from the area of the oil reservoir during drilling operations. The analysis of such well log and core data is well known to those skilled in the art.

Similarly, the reservoir permeability can be estimated from well logs by techniques well known to those skilled in the art. In addition, reservoir permeability can be estimated directly from waterflooding pressure-water flow curves from a particular reservoir.

Thus, the magnitude of required acoustic slow wave frequencies can be predicted directly from Eq. (1) by using well log and other geophysical data, such as in situ oil density and viscosity, commonly available for a given oil reservoir.

To illustrate that required slow wave frequencies are in physically accessible domains with ultrasonic equipment commercially available, we calculate acoustic slow wave frequencies for several different sediment size ranges. In this analysis we make use of the Carmen-Kozeny equation, as discussed in Williams (1968). This approximation has the advantage of being a physically plausible form suggested by physical arguments, with a phenomenologically determined prefactor:

$$k=B\ \phi^3/\{S_v^2(1-\phi)^2\} \tag{3}$$

where B is a constant, typically on the order of 5, and $S_v$ is the particle surface area per unit volume within the aggregate. $S_v$ will depend on the particle size and packing of the particles, and is inversely proportional to particle diameter (Williams, 1968). Several specific particle packings have been used to calculate both $S_v$ (for use in Equations (1)–(3)) and %S using information on the packings provided in Williams (1968). For example, for cubic close packing of particles, the porosity $\phi$=0.476, and $S_v=\pi/D$, where D is the particle diameter. For body centered cubic packing the porosity $\phi$=0.395, and $S_v=2\pi/D$. For face centered cubic packing the porosity $\phi$=0.26, and $S_v=4\pi/D$. For random packing the porosity $\phi$=0.63, and $S_v=\pi/D$. Thus, the parameter $S_v$ is related to sediment size. This information on $S_v$, plus Equations (2)–(3) allow the compressional slow wave frequency to be estimated by Eq.(1). This information on $S_v$, plus Equations (2)–(3) allow the compressional slow wave frequency to be estimated by Eq.(1). This information on $S_v$, plus Equations (1) and (3) allow the compressional slow wave frequency to be estimated by:

$$f_c=\eta\{S_v^2(1-\phi)^2\}/(2\eta B\phi^2\rho_f). \tag{4}$$

Useful compressional slow wave frequency can be in the range between ±15% of the calculated or measured peak slow wave frequency.

Figure 3:
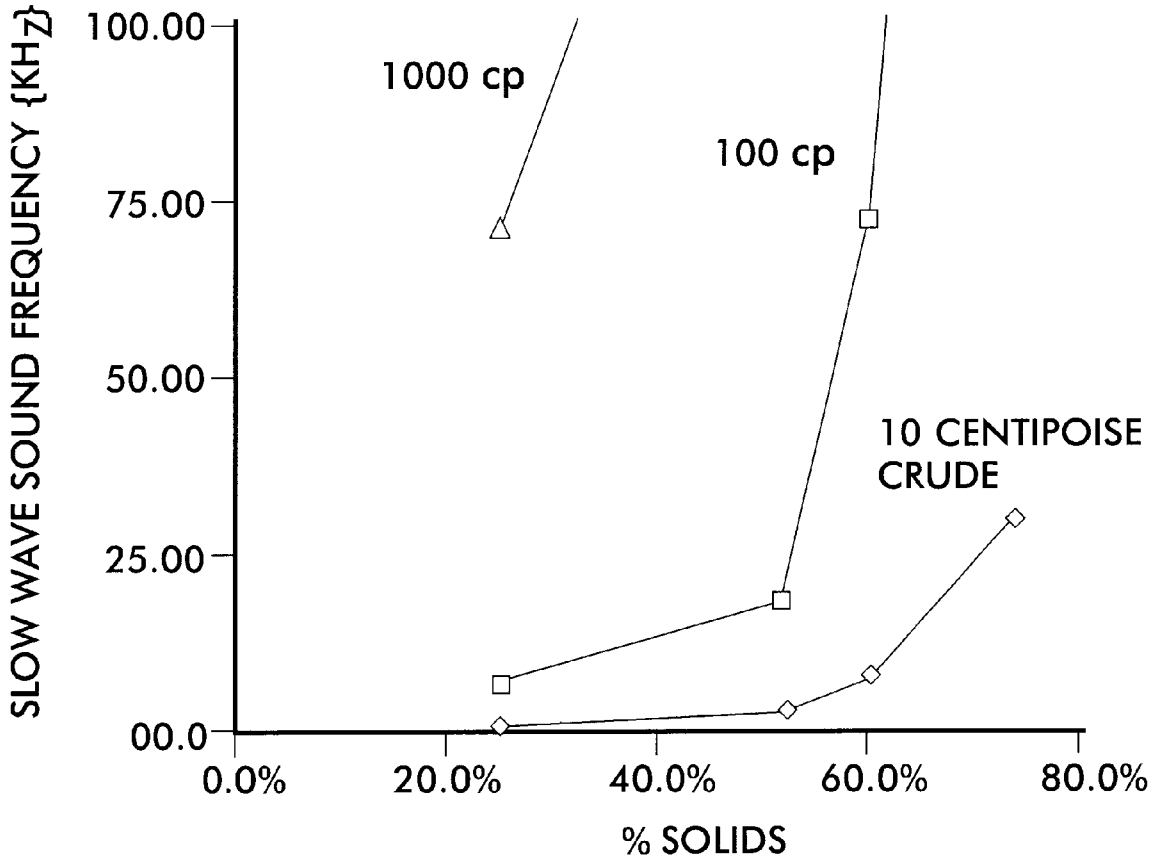
FIGS. 3–6 illustrate the acoustic slow wave frequency for silt sized sediment particles or pores.
Figure 4:
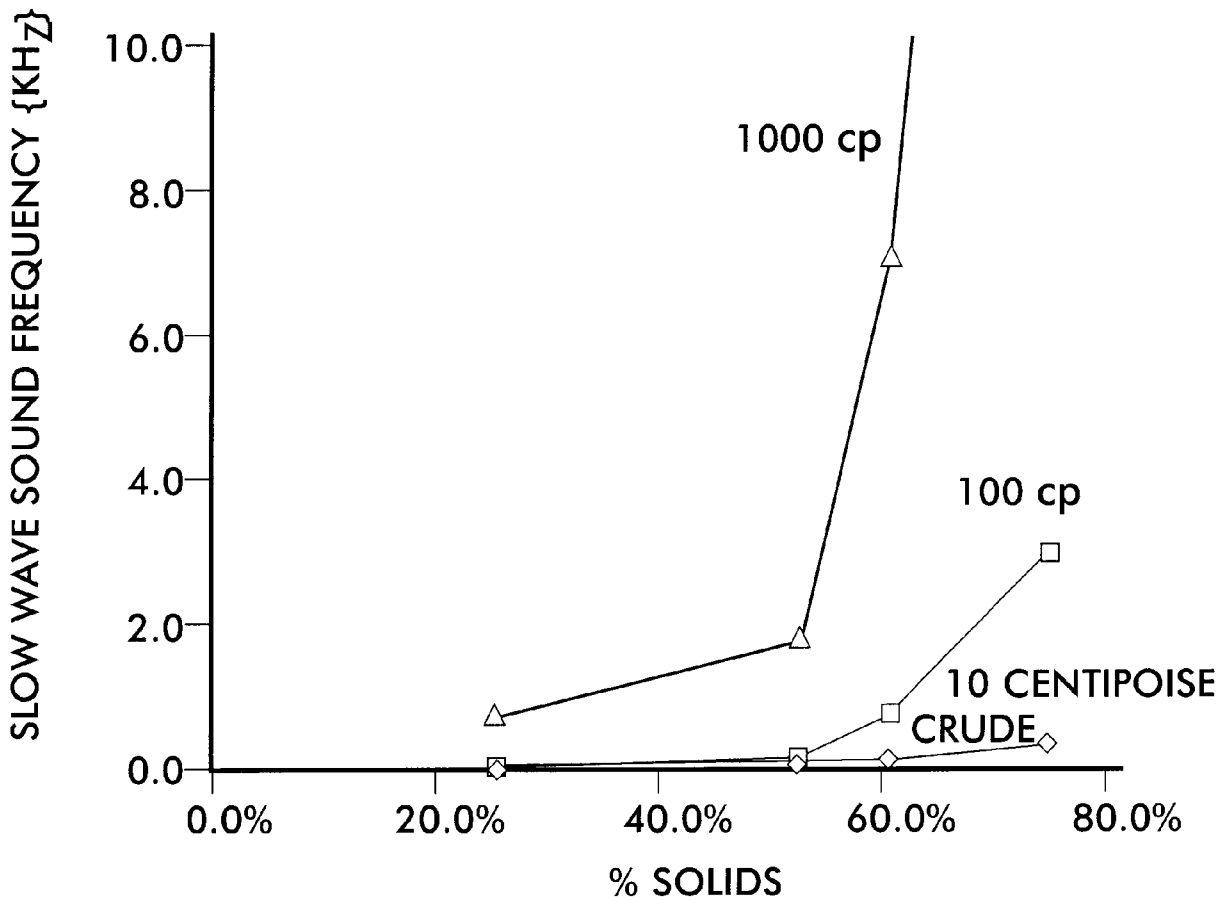
Figure 5:
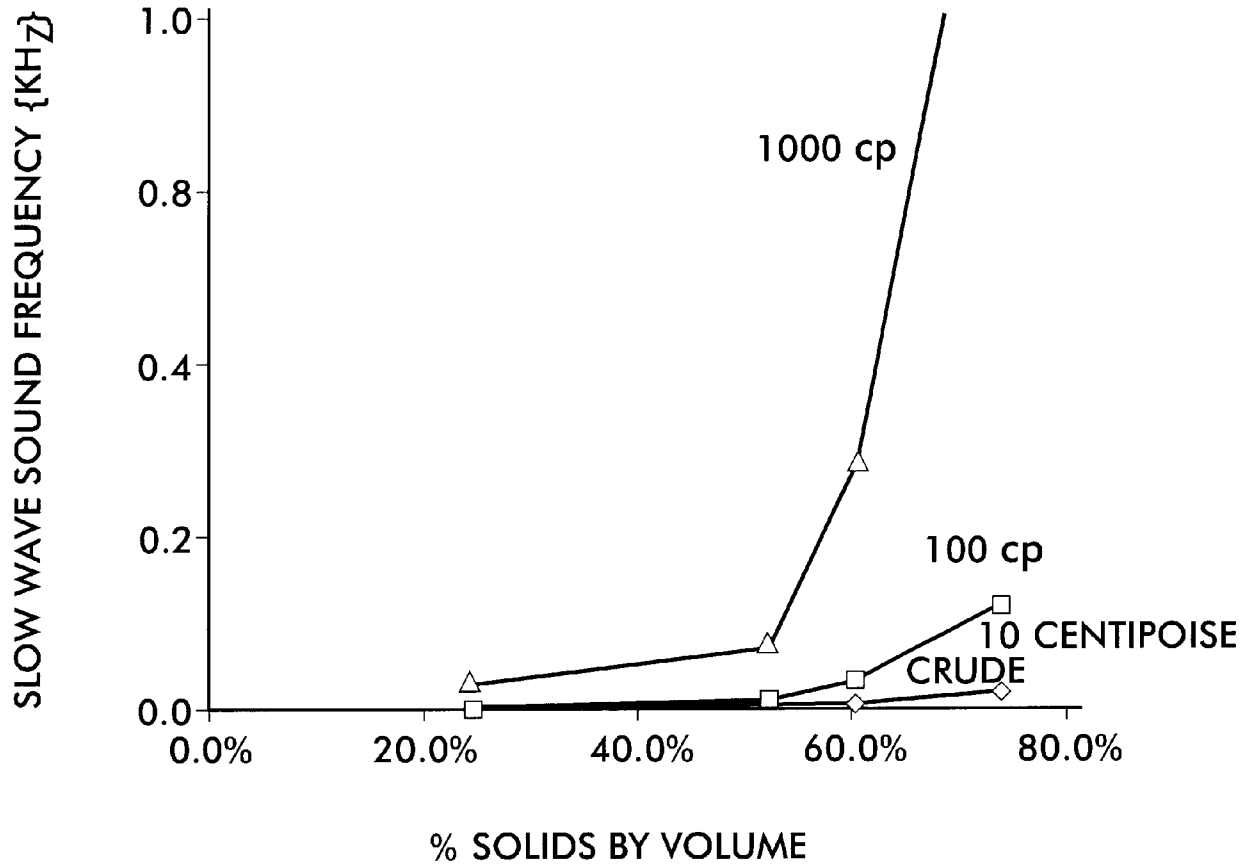
Figure 6:
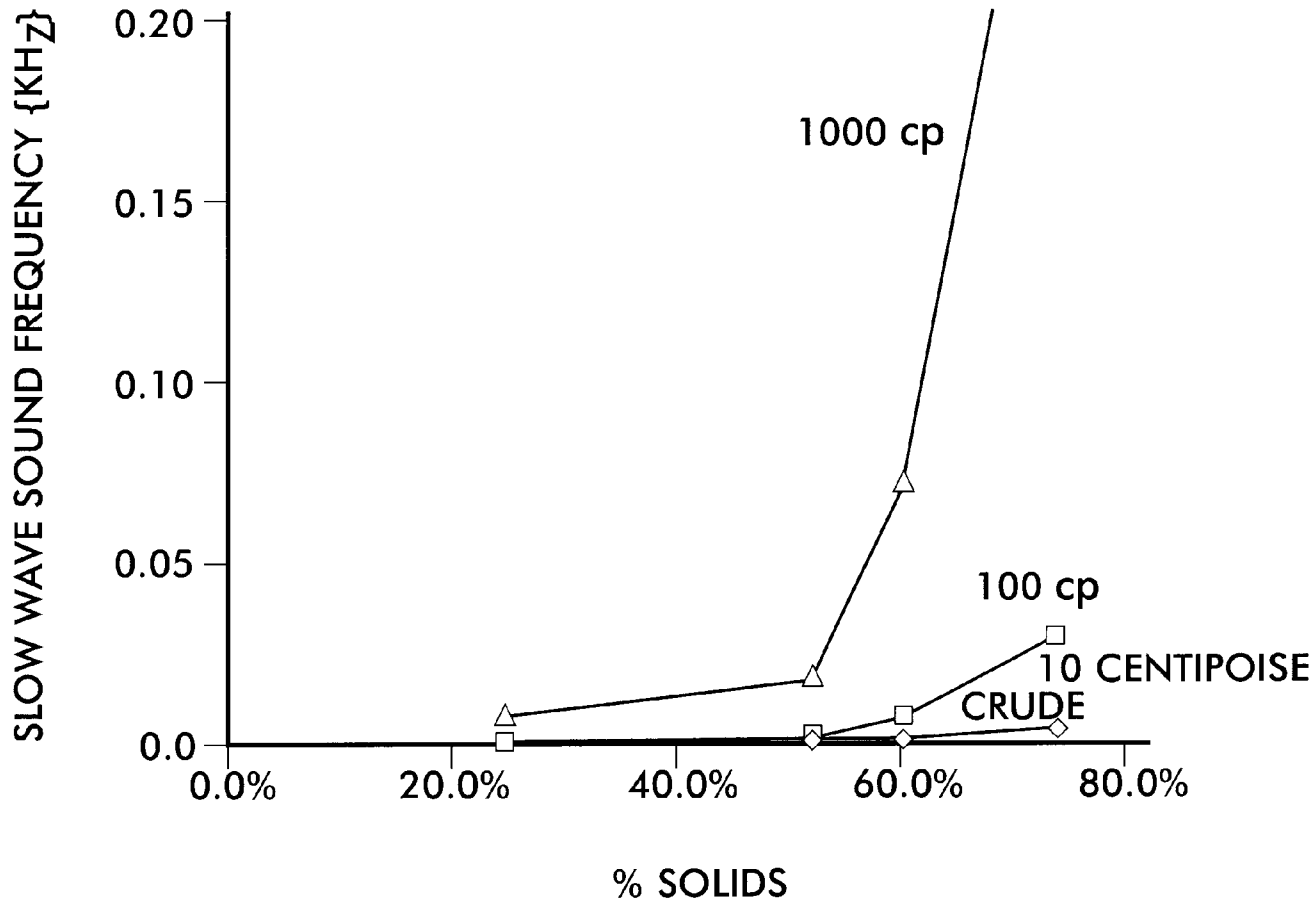
Figure 7:
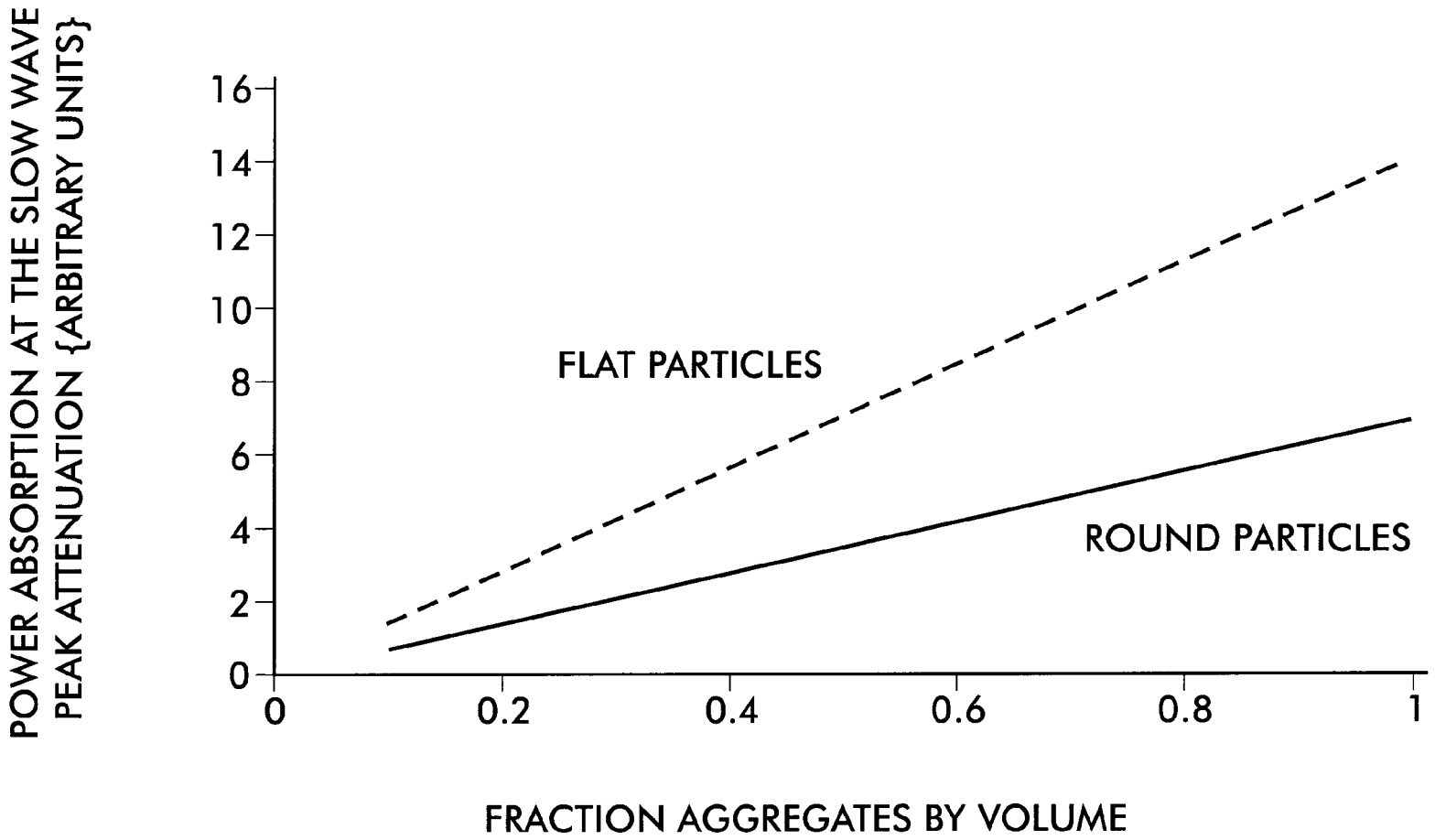
In FIG. 7 the effect of pore shape on the acoustic slow wave peak frequency is illustrated.

Using these results, it is possible to estimate the slow wave frequency as a function of percent solids, %S, (or equivalently, rock porosity ($\phi$=100−%S) and its dependence on sediment size. This is shown in FIG. 3 for oils of various viscosities in silt-size sediments (1/200 mm particle size). Similarly, in FIG. 4 we show the frequencies for very small sand (1/20 mm) sized sediments, FIG. 5 for medium sand (0.25 mm), and in FIG. 6 for coarse sand (0.5 mm). Actually, since in most reservoirs the particles have undergone metamorphosis that has resulted in grains being glued together, or in some cases such as carbonates separate grains never existed, it is better to think of these "particle" sizes rather as typical pore sizes.

It is, therefore, evident that there has been provided a method for improving oil recovery using ultrasound technique, in accordance with the present invention, that fully satisfies the aims and advantages hereinbefore set forth. While this invention has been described in conjunction with one embodiment thereof, it is evident that many alternatives, modifications and variations will be apparent to those skilled in the art. Accordingly, it is intended to embrace all such alternatives, modifications and variations as they fall within the spirit and broad scope of the appended claims.

We claim:

1. A method for recovering oil from a subterranean formation comprising:

injecting an aqueous composition into said formation and displacing said oil toward one or more production wells;

subjecting the aqueous composition to an ultrasonic signal to release oil from the formation, said subjecting step includes applying predefined acoustic slow wave frequencies, said applying step includes determining said predefined acoustic slow wave frequencies with following equation $$f_c=\eta\phi/(2\pi k\rho_f)$$

where $\eta$ is the oil fluid viscosity, $\pi$ is a rock porosity of said formation, k is the formation permeability, and $\rho_f$ is the oil fluid density; and removing the aqueous composition containing oil from said one or more production wells.

2. The method of claim 1, wherein said aqueous composition is steam.

3. The method of claim 1, wherein said aqueous composition is water.

* * * * *